US008161683B2

(12) United States Patent
Van Parys

(10) Patent No.: US 8,161,683 B2
(45) Date of Patent: Apr. 24, 2012

(54) METALWORK OF A WINDOW AND ELEMENTS THEREOF

(76) Inventor: Remi Emiel Van Parys, Waregem (BE)

( * ) Notice: Subject to any disclaimer, the term of this patent is extended or adjusted under 35 U.S.C. 154(b) by 558 days.

(21) Appl. No.: 12/355,105

(22) Filed: Jan. 16, 2009

(65) Prior Publication Data

US 2009/0183449 A1 Jul. 23, 2009

(30) Foreign Application Priority Data

Jan. 17, 2008 (BE) ..... 2008/0036

(51) Int. Cl.
*E05D 15/52* (2006.01)

(52) U.S. Cl. ..... 49/192; 49/193; 49/382; 49/149; 292/32; 292/33; 292/141

(58) Field of Classification Search ..... 49/192, 49/193, 382, 149; 292/DIG. 20, DIG. 47, 292/32, 33, 38, 137, 141
See application file for complete search history.

(56) References Cited

U.S. PATENT DOCUMENTS

| | | | | | |
|---|---|---|---|---|---|
| 3,911,621 | A * | 10/1975 | McHeffey | 49/192 |
| 3,994,093 | A * | 11/1976 | Mayer et al. | 49/192 |
| 4,223,928 | A * | 9/1980 | Roth | 292/157 |
| 4,339,892 | A * | 7/1982 | Ulbricht et al. | 49/192 |
| 4,602,457 | A * | 7/1986 | Kreusel | 49/192 |
| 4,637,165 | A * | 1/1987 | Schneider | 49/192 |
| 4,739,583 | A * | 4/1988 | Tonsmann et al. | 49/192 |
| 4,903,434 | A * | 2/1990 | Loos | 49/192 |
| 5,076,015 | A * | 12/1991 | Manzalini | 49/192 |
| 5,226,256 | A * | 7/1993 | Fries et al. | 49/13 |
| 5,881,498 | A * | 3/1999 | Goggin et al. | 49/192 |
| 7,013,604 | B1 * | 3/2006 | Moody et al. | 49/341 |
| 7,017,301 | B2 * | 3/2006 | Balbo Di Vinadio | 49/192 |
| 7,340,860 | B2 * | 3/2008 | Balbo Di Vinadio | 49/192 |
| 2005/0022941 | A1 * | 2/2005 | Di Vinadio | 160/15 |
| 2005/0246979 | A1 * | 11/2005 | Balbo Di Vinadio | 52/204.1 |
| 2006/0207182 | A1 * | 9/2006 | Van Parys | 49/192 |

FOREIGN PATENT DOCUMENTS

| | | |
|---|---|---|
| DE | 196 05 047 | 6/1997 |
| EP | 0 487 466 | 5/1992 |
| GB | 2190704 A * | 11/1987 |
| WO | WO 01/94729 | 12/2001 |

* cited by examiner

*Primary Examiner* — Katherine W Mitchell
*Assistant Examiner* — Marcus Menezes
(74) *Attorney, Agent, or Firm* — Bacon & Thomas, PLLC

(57) ABSTRACT

A metalwork for a window having a fixed frame and a leaf. The metalwork also includes a control which enables opening and closing of the leaf so as to turn around vertical or horizontal axes depending on the position of the control.

15 Claims, 15 Drawing Sheets

METALWORK OF A WINDOW AND ELEMENTS THEREOF

The present invention concerns a metalwork of a window and the elements thereof.

In particular, the invention aims the metalwork of a window with a fixed frame and a leaf as well as a control of the metalwork to open and close the leaf which can turn round a vertical axis or which can tilt round a horizontal axis, depending of the position of the control.

The control of such metalwork is usually provided with a control crank that can be put in three positions, namely a closing position to close and lock the window in a closed position; a first opening position, turned a quarter of a turn so as to open the window from the closed position around a vertical hinge pin, and a second opening position, turned a quarter of a turn further so as to tilt the window open as of the closed position around a horizontal hinge pin.

This type of metalwork is called turn tilt metalwork.

The tilt before turn type of metalwork, whereby the control of the window can tilt in the first opening position, whereas the window can turn in the second opening position, as opposed to with the turn tilt type of metalwork whereby it is just the other, way round.

A disadvantage is that both types of metalwork are different and that, consequently, the desired type must be chosen at the time of purchase of the window or metalwork.

If one wishes to switch from a turn tilt type of metalwork to a tilt before turn type of metalwork, one will be forced to replace the metalwork as a whole or practically entirely.

Such a transformation is relatively expensive because of the cost price of new metalwork and the labour costs of a craftsman to carry out the transformation.

From WO 01/94729 is known a type of metalwork for a window with a fixed frame and a leaf as well as a control for the metalwork to open and close the leaf which can turn round a vertical axis or which can tilt round a horizontal axis, depending on the position of the control which can move from a closing position in which the window is closed to a first opening position for one of either movements of the wing, i.e. turning for a turn tilt type of window or tilting for a tilt before turn type of window, and further on to a second opening position for the other movement, ice, tilting for a turn tilt type of window or turning for a tilt before turn type of window, and whereby a shear mechanism is provided with a main arm which can freely rotate in relation to the leaf so as to make the window tilt and which can be locked in relation to the leaf by means of a locking device with two coupling elements so as to make the window turn, i.e. a coupling element on the main arm and a coupling element on the leaf which can mesh by means of the control of the metalwork so as to lock the main arm or which can be moved apart in view of the free movement of the main arm, whereby at least one of both coupling elements is made as an adjustable part which makes it possible to transform the shear part of the metalwork from a turn tilt type to a tilt before turn type, and vice versa, by means of a mutual readjustment.

In this way, by simply readjusting some elements of the metalwork's shear part, one can switch from one type of metalwork to another type of metalwork without having to buy any new metalwork or elements thereof, and one can switch between both types of metalwork at any time without having to mount or dismount the metalwork as a whole.

A disadvantage, however, is that the adjustable part is relatively complex and that, in order to change the type of metalwork, it must each time be removed and turned.

The present invention aims to remedy one or several of the above-mentioned disadvantages.

To this aim, the invention concerns a metalwork of the above-mentioned type whereby the coupling element is provided on the leaf on a slide lath which can slide, by means of the control, over an outer perimeter of the leaf, and whereby the coupling element on the main arm is designed as a rotating arm on which is provided an eccentric gudgeon which can work in conjunction with a complementary female coupling element on the slide lath, which aim can rotate half a turn on the main arm between two positions that can be locked, corresponding to a turn tilt or a tilt before turn type of metalwork respectively.

An advantage is that the transformation can be carried out quickly and easily by anyone whatsoever, and that it is not absolutely necessary to call in a craftsman, which implies that no costs will have to be paid to a craftsman either.

The metalwork is preferably such that the entire transformation from one type of metalwork to the other type of metalwork can be obtained by readjusting two elements at the most, preferably including the above-mentioned rotating arm with the eccentric gudgeon, as a result of which the transformation can be done very quickly.

As is known, the above-mentioned control of the metalwork is usually composed of one or several slide laths which can slide over the outer perimeter of the leaf in a groove of the metalwork running in the outer perimeter of the leaf, whereby an angle drive is applied in one or several corners of the leaf of the window, formed of a hooked guide in which slides an elastic, flexible lath, which lath is coupled to the above-mentioned slide laths at its far ends, on the edges on either side of the angle drive.

A disadvantage of such a known angle drive is that the coupling with the above-mentioned slide laths may be rather time-consuming and preferably requires the intervention of a craftsman.

According to a special aspect of the invention, the flexible lath of the angle drive is provided with a coupling piece in the shape of a snap-in system at its far ends to connect other of the above-mentioned slide laths or other elements of the metalwork to.

In this way, the mounting and dismounting of the metalwork is very easy and thus feasible for a non-craftsman.

According to a preferred embodiment, the coupling piece is formed of a holder which is fixed under the flexible lath at a far end concerned and in which a body has been provided which is pushed in the direction of the lath by means of a spring and on which has been provided a protrusion extending through a passage in the flexible lath and which protrudes over a certain length from the top of the latter when in rest, whereby said protrusion has been designed to work in conjunction with a passage or a recess of a part of the metalwork to be coupled.

In order to better explain the characteristics of the invention, the following preferred embodiment of the metalwork for a window according to the invention and the elements thereof are described by way of example only without being limitative in any way, with reference to the accompanying drawings, in which:

FIG. 1 shows a view in perspective of a window that is turned open, whereby said window is provided with metalwork to open and close the window;

FIG. 2 schematically shows the metalwork for a window according to the invention, seen in perspective and whereby most of the elements are disassembled;

Figure 2:
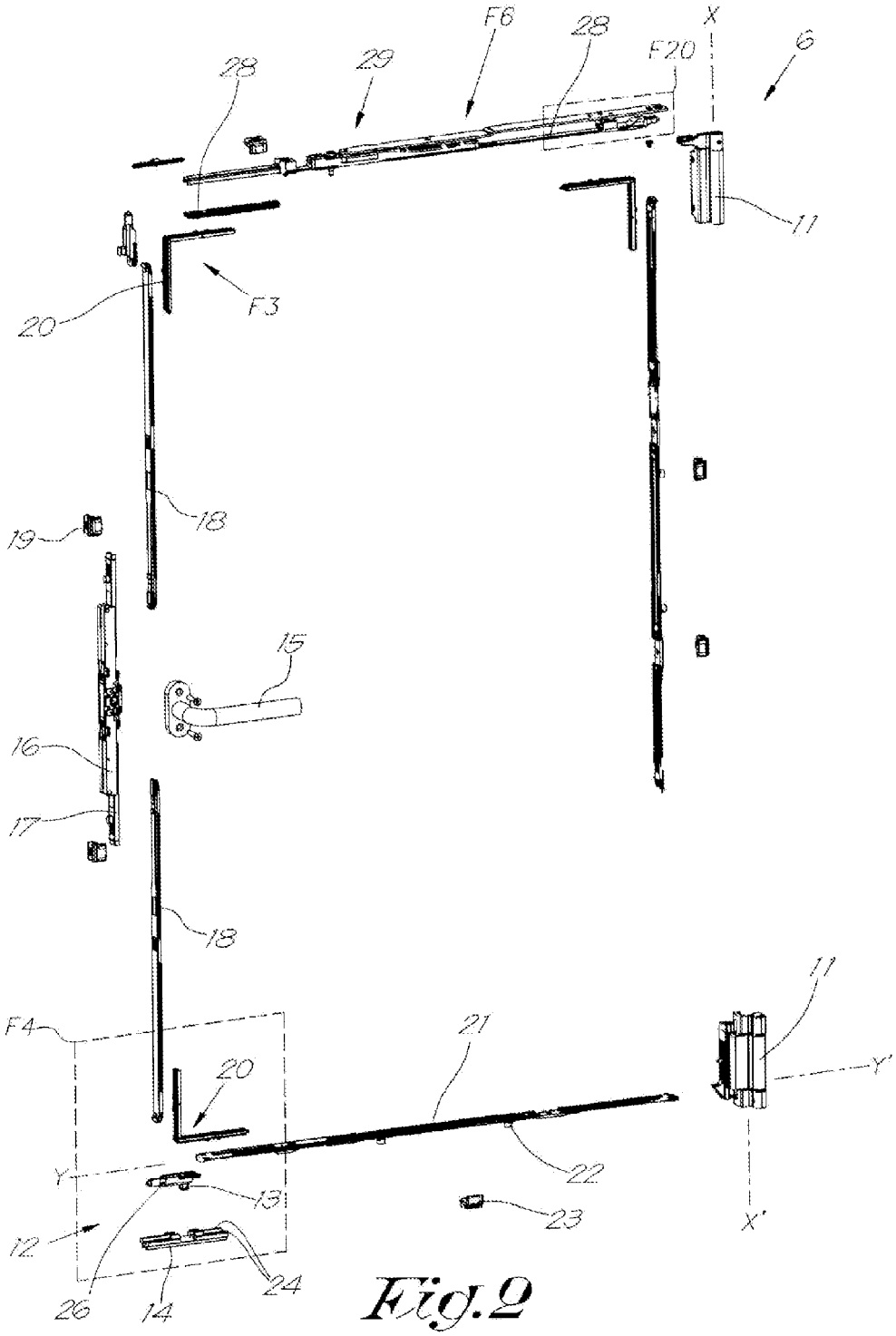
Figure 3:
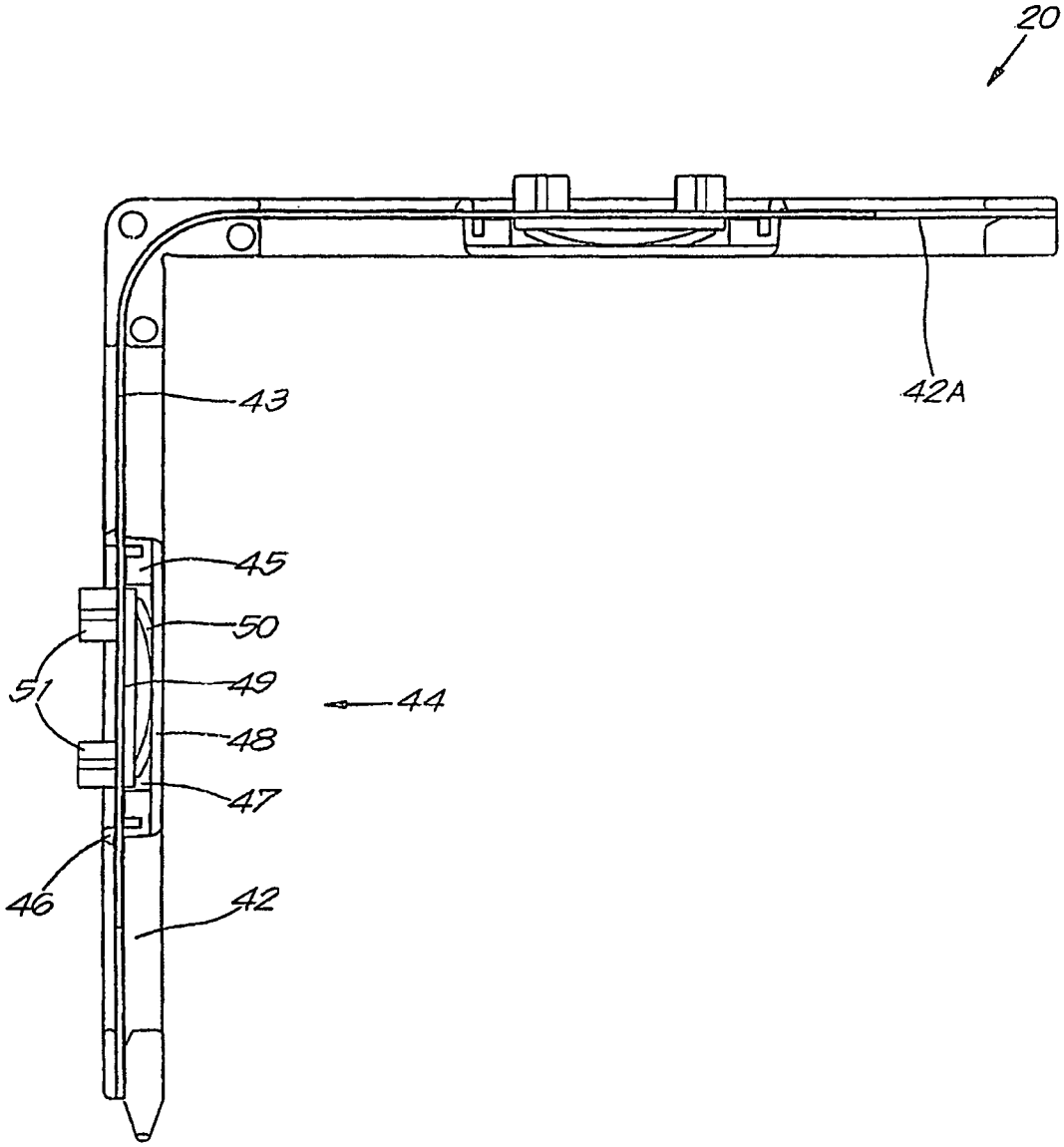
FIG. 3 shows a section of the angle drive indicated by F3 in FIG. 2 to a larger scale.
Figure 9A:
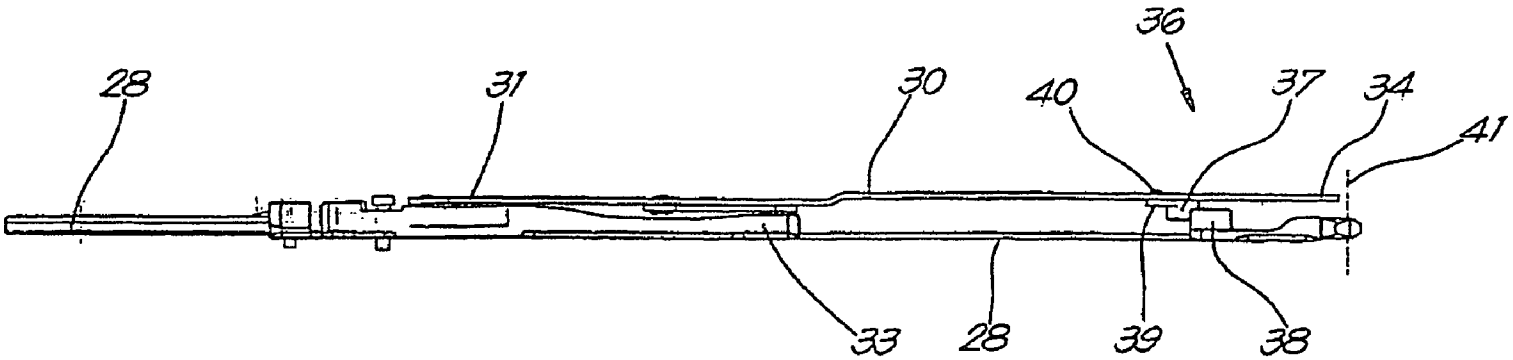
FIGS. 9A and 9B show respective views analogous to those of FIGS. 6 and 4, for the metalwork of FIG. 2 in a turn tilt configuration, and such for the closing position of the window.
Figure 9B:
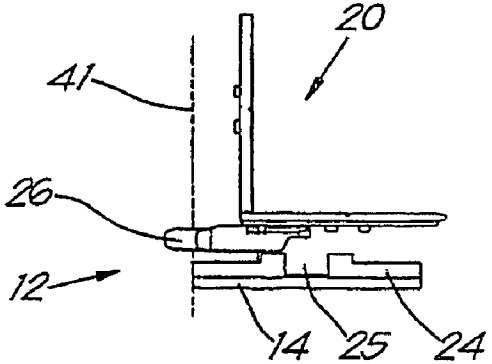
Figure 12A:
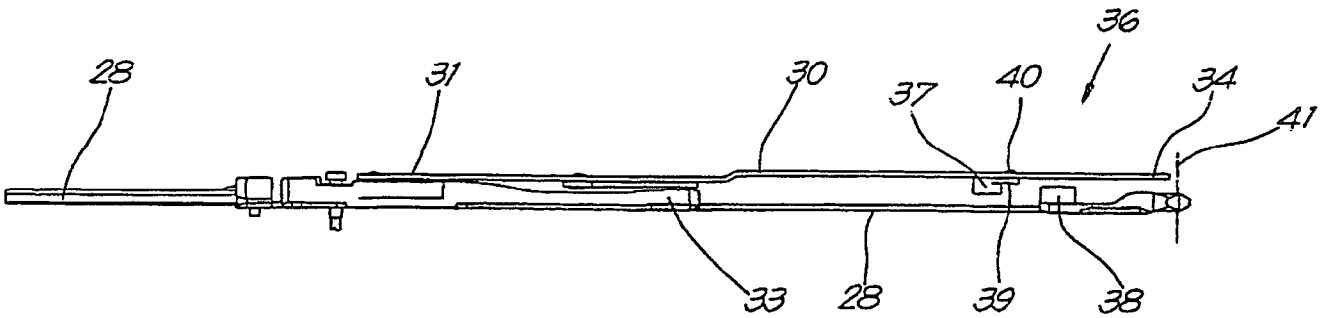
Figure 12B:
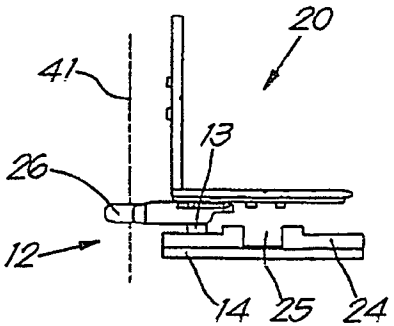
Figure 15:
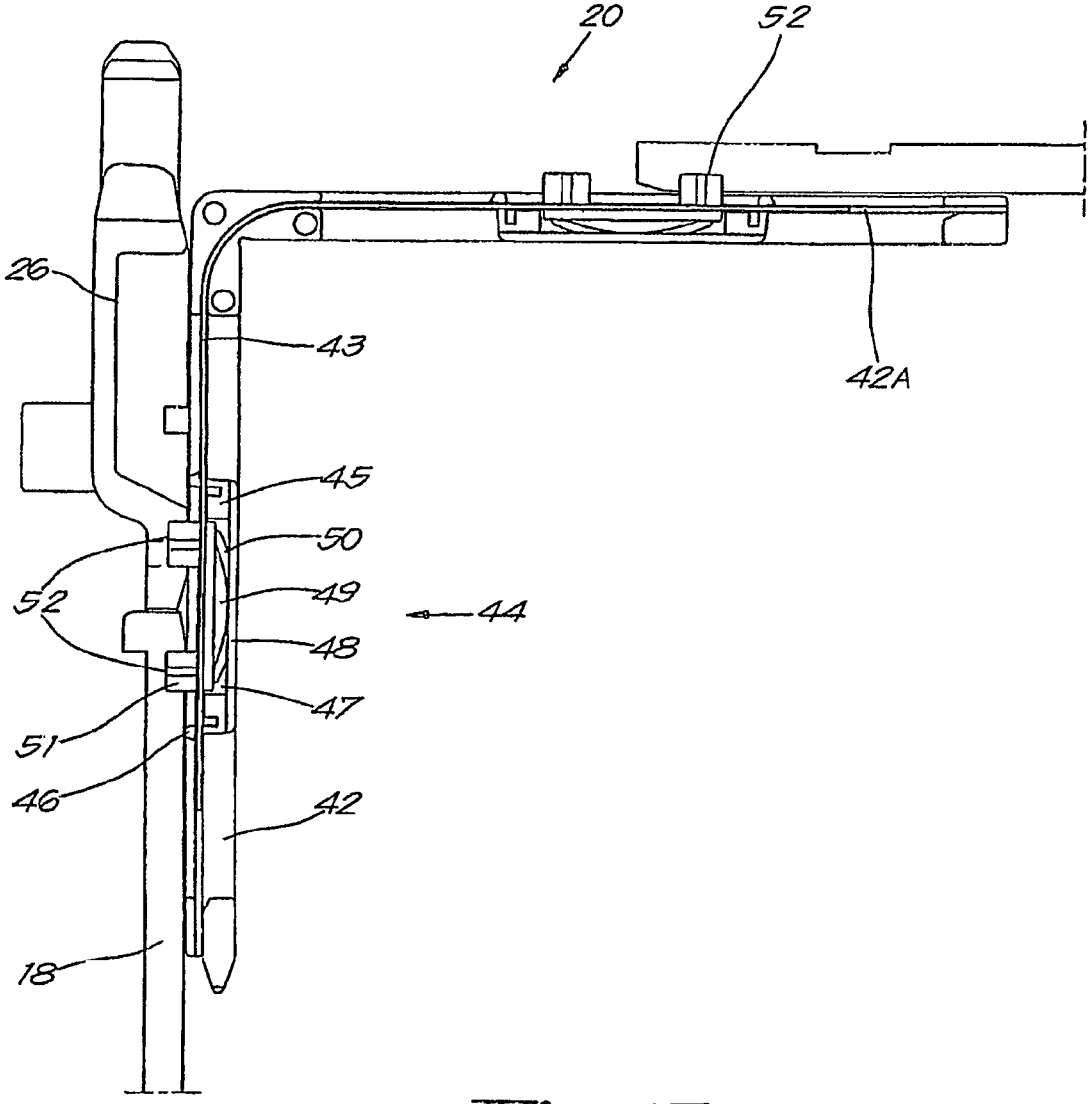
Figure 16:
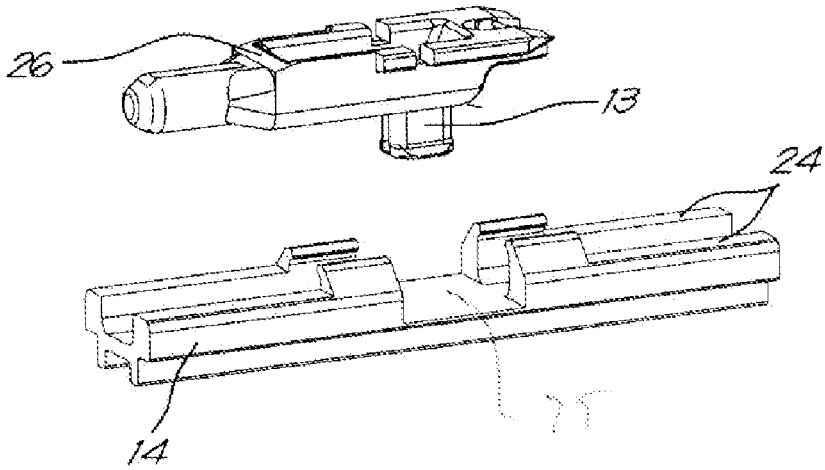
Figure 17:
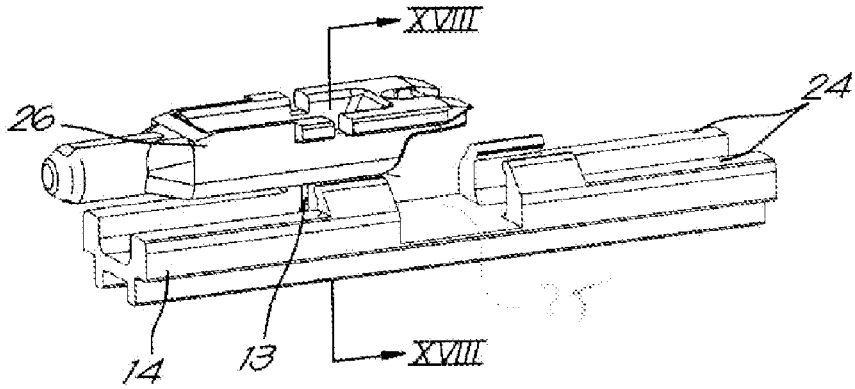
Figure 18:
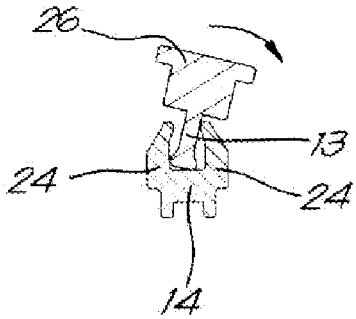
Figure 19:
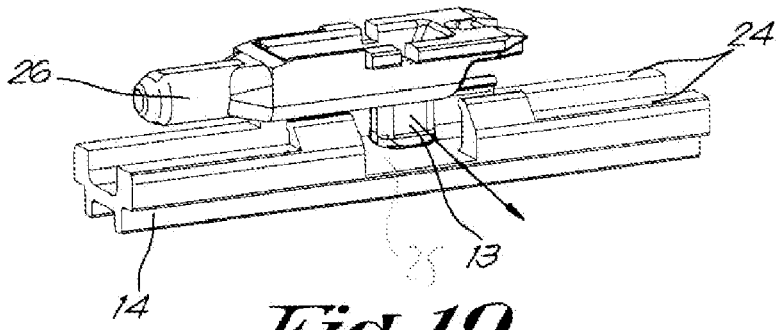
Figure 20:
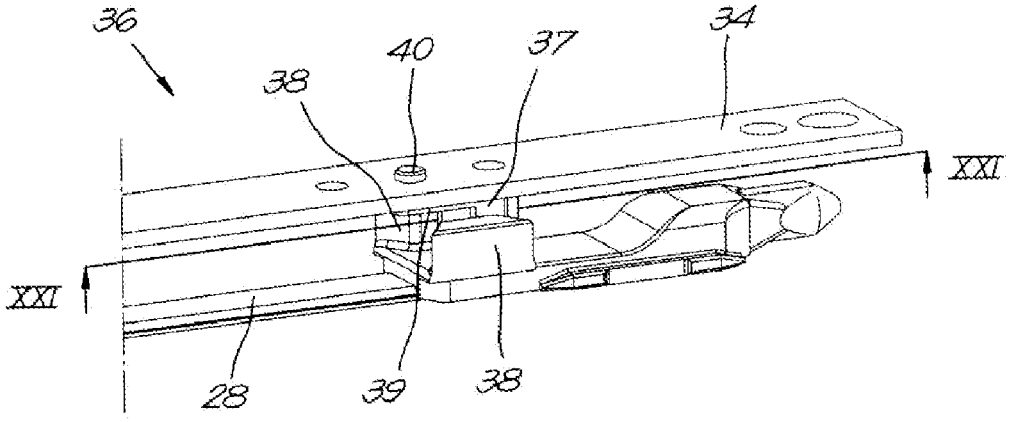
Figure 21:
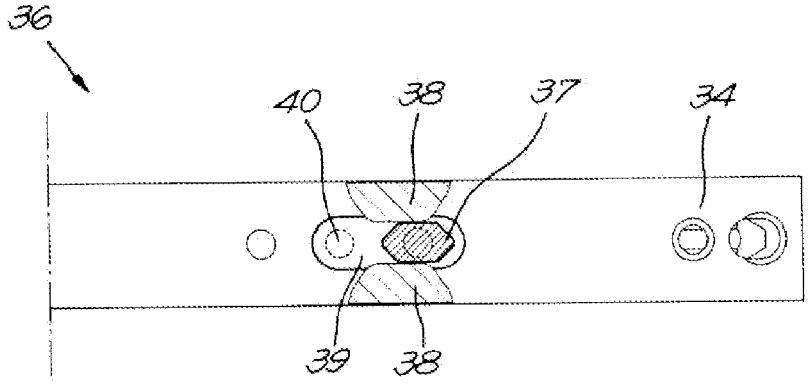
Figure 22:
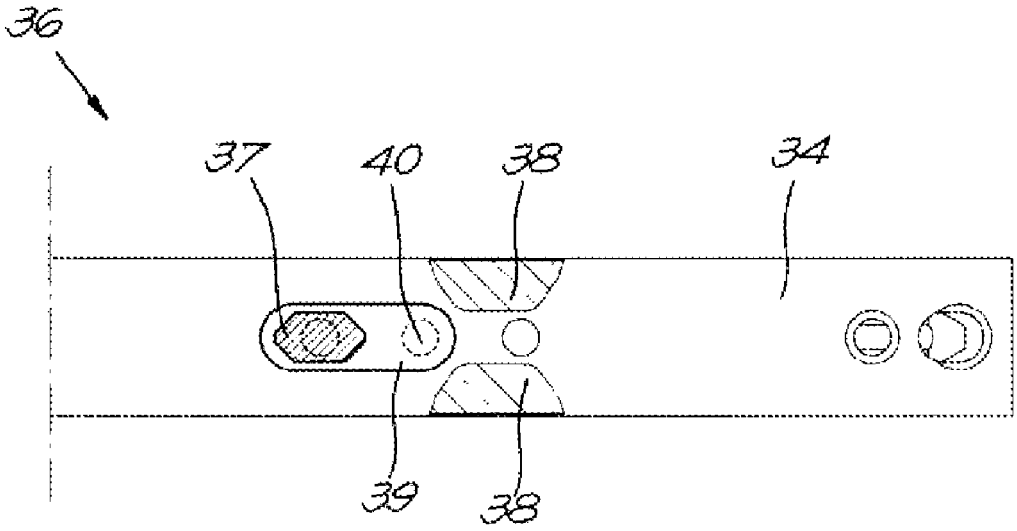

FIGS. 10A and 10B, 11A and 11B respectively, show the same views as in FIGS. 9A and 9B, but for a turning position, tilting position respectively of the window;

FIGS. 12A and 12B respectively show the same views as in FIGS. 9A and 9B, but for the metalwork of FIG. 2 in a tilt before turn configuration and for the closing position of the window;

FIGS. 13A and 13B, 14A and 14B respectively, show the same views as in FIGS. 12A and 12B, but for a tilting position, a turning position of the window respectively;

FIG. 15 shows the coupling between the angle drive of FIG. 3 and other elements of the metalwork;

FIG. 16 represents on a larger scale the hinge parts shown in the box F4 in FIG. 2;

FIG. 17 shows the hinge parts of FIG. 16 in a coupled position as to allow tilting of the leaf;

FIG. 18 represents a cross section through line XVIII-XVIII in FIG. 17, showing the tilting movement;

FIG. 19 is a representation as in FIG. 17 but in a coupled position as to allow turning of the leaf;

FIG. 20 represents on a larger scale the part of the scissor mechanism indicated by F20 in FIG. 2;

FIG. 21 shows a cross sectional view through line XXI-XXI with the rotating arm of the scissor mechanism turned in a position for a turn tilt type of window;

FIG. 22 showing the cross sectional view of FIG. 21, but with the rotating arm of the scissor mechanism turned in a position for a tilt before turn type of window.

Figure 1:
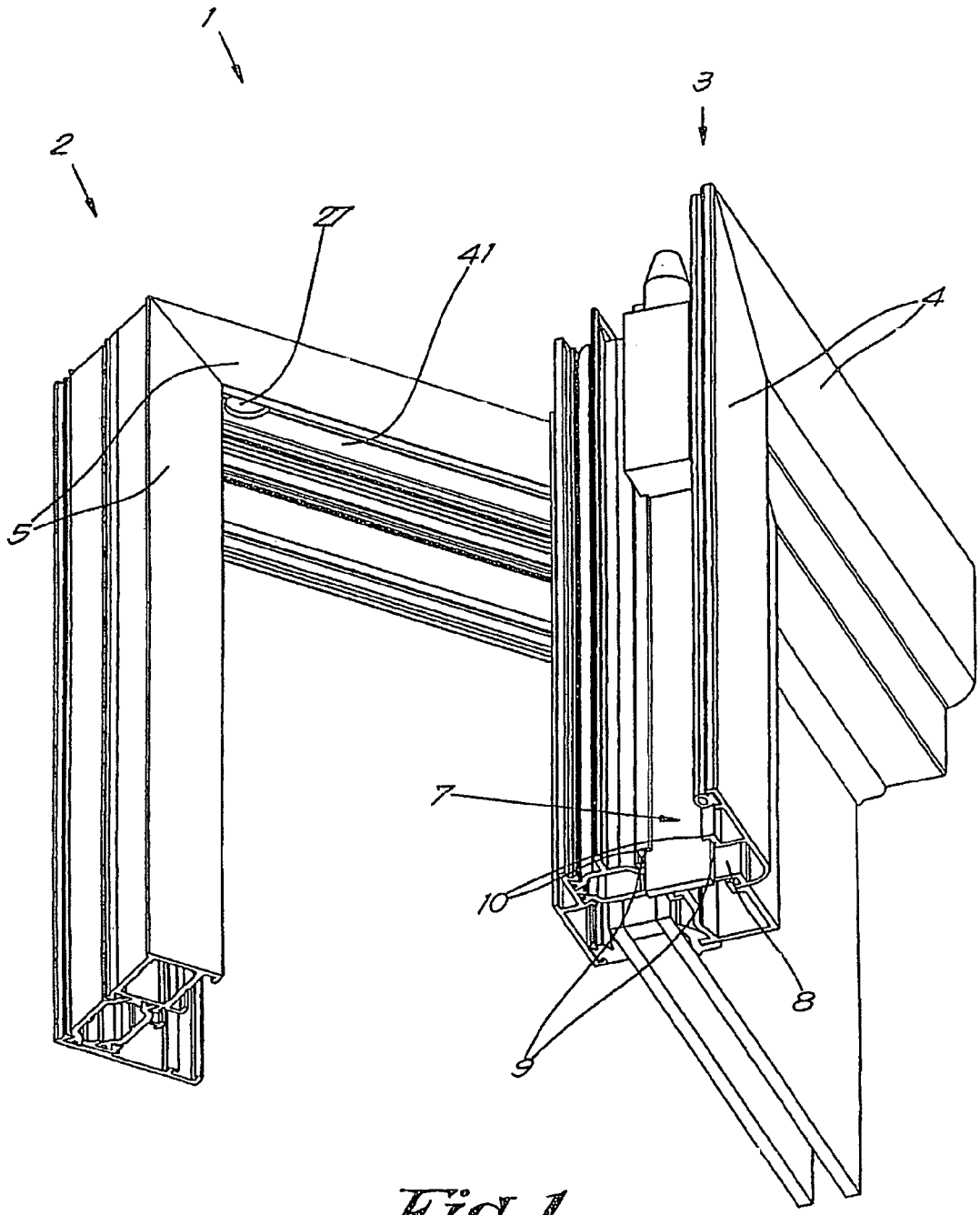

The window 1 of FIG. 1 is, as is known, composed of a fixed frame 2 and a leaf 3 with which the window can be opened.

The frame and the leaf are usually composed of posts 4, 5 respectively.

In order to open and close the window 1, a metalwork 6 is provided, whose preferred embodiment according to the invention is represented in FIG. 2 with elements of which a number are mounted in a sliding manner in a groove 7 of the metalwork running over the outer perimeter 8 of the leaf 3 and which is formed of two standing ribs 9 of the posts 4 placed at a distance from one another and whose free edges are bent towards each other.

The metalwork comprises two hinges 11 which make it possible for the leaf 3 to turn open round the axis X-X'.

The lower hinge 11 is a double-acting hinge which enables a rotation round the axis X-X' as well as a tilting round the axis Y-Y'.

Figure 4:
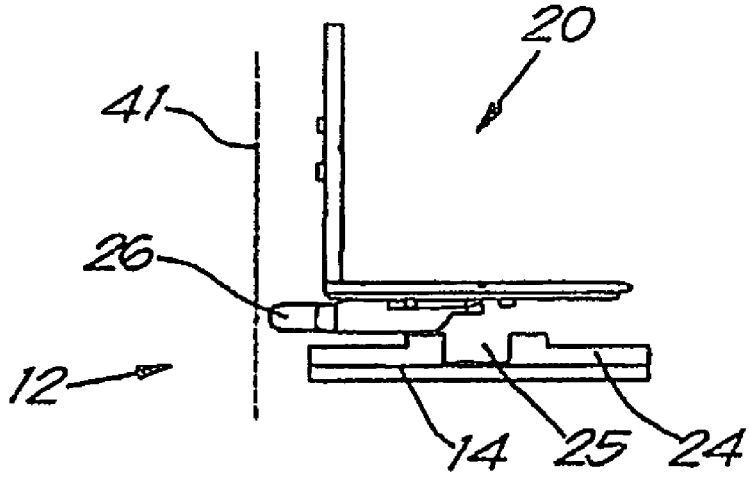
FIG. 4 shows a front view of the elements of the metalwork in the lower left corner, indicated by F4, represented in an operational configuration.
Figure 5:
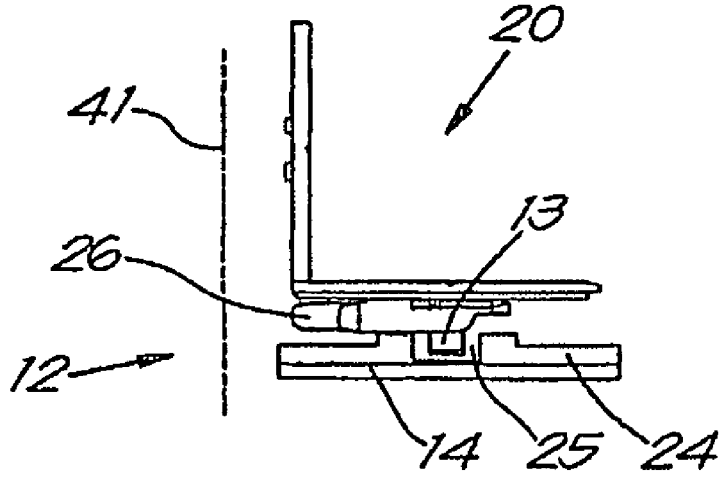
FIG. 5 shows a view as in FIG. 4, but for another position.

In order to make the leaf 3 tilt, the lower hinge 11 works in conjunction with a detachable hinge with two hinge parts that can be disconnected, namely a hinge pin 13 on the leaf 3 and a U-shaped element 14 on the frame 2 respectively, in which the hinge pin 13 can be pushed in view of a hinged co-operation between the parts 13 and 14, as represented in FIGS. 4 and 5.

Further, the metalwork 6 mainly comprises a number of elements, namely a control crank 15 mounted on a base 16 which is fixed to a standing edge of the leaf 3 and in which a catch piece 17 can slide up and down by means of an internal mechanism, not represented, which is set in motion by turning the control crank 15.

In the groove in the metalwork 7 of the above-mentioned standing edge of the leaf 3, slide laths 18 are provided above and under the catch piece 17 which are coupled to the catch piece 17.

The lower slide lath 18 is coupled with its lower end to an angle drive 20, as represented in more detail in FIG. 3, and which can transfer the up-and-down movement of the lower slide lath 18 to a slide lath 21 which can shift to and fro horizontally in the groove in the metalwork 7 of the lower post 4 of the leaf 3, whereby said slide lath 21 is provided with closing gudgeons 22 which, in a closed position of the leaf 3, thanks to a shift of the slide lath 21, can mesh with closing points 23 so as to lock the window in its closed position.

The hinge pin 13 is in this case coupled to the angle drive 20 and/or to the slide lath 21, whereby a shift makes sure that the hinge pin 13 can be coupled to or disconnected from the U-shaped element 14 which is in this case formed of a U-shaped post with standing legs 24 which are interrupted over a certain length in a central part by a recess 25 which is wide enough to turn the hinge pin 13 crosswise away from the U-shaped post 14 at the leaf.

The hinge pin 13 is in this case part of a locking pin 26 provided on the angle drive 20 and which can shift over the perimeter of the leaf 3 so as to mesh in a recess 27 or a cavity in the frame 2 in order to lock the leaf 3 in a closed position of the window 1.

The upper slide lath 18 is coupled with its top end to a second angle drive 20 which activates an additional locking pin 26 and which can transfer the up-and-down movement of the upper slide lath 18 onto a slide lath 28 which can shift to and fro horizontally in the groove in the metalwork 7 of the upper post 4 of the leaf 3.

The slide lath 28 continues under a shear mechanism 29, which shear mechanism is designed such that it can restrict the tilting movement of the leaf 3.

Figure 6:
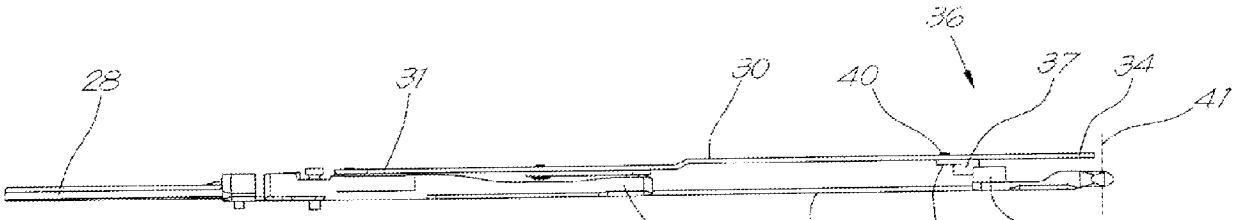
FIGS. 6 and 7 show a front view and a top view respectively of the part which is indicated with F6 in FIG. 2.
Figure 7:
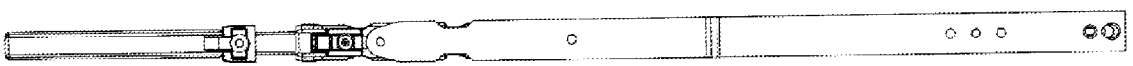
Figure 8:
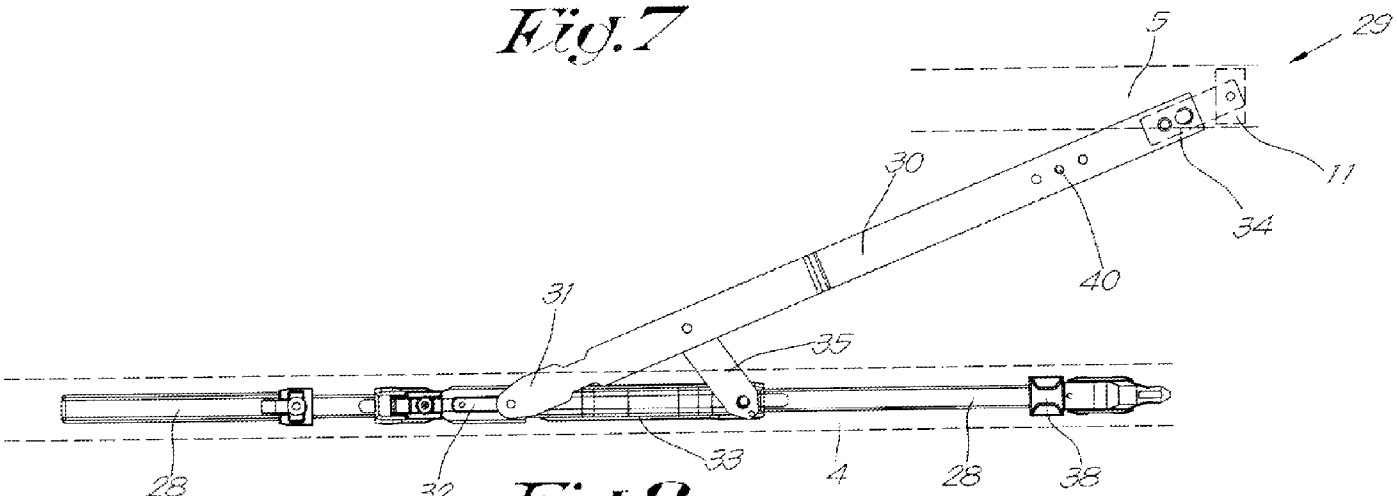
FIG. 8 shows a view as in FIG. 7, but for another position.

The shear mechanism 29 is represented in more detail in FIGS. 6 to 8 and it mainly consists of a main arm 30 which is hinge-mounted to a carriage 32 with one far end 31 which can shift in the longitudinal direction of the upper post 4 in a guide 33 which is fixed to this post 4 and where the slide lath 28 runs under.

The other far end 34 of the main arm 30 is connected in the known manner to the upper hinge 11 and it is connected via a hinge arm 35 to the guide 33.

The shear mechanism 29 is further provided with a locking device 36 which can lock the rotation of the main aim 30 in relation to the leaf 3 or of the slide lath 28 fixed to the latter.

Said locking device 36 in this case consists of two coupling elements, a coupling element 37 in the shape of a gudgeon on the main arm 30 and a complementary female coupling element 38 on the slide lath 28 respectively, whereby the coupling element 37 on the main arm 30 can be adjusted in the longitudinal direction of the main arm 30 between two fixed positions corresponding to a position for a turn tilt metalwork, as shown in FIGS. 9 to 11, and a position for a tilt before turn metalwork, as shown in FIGS. 12 to 14, respectively.

In the given example, the gudgeon 37 can be adjusted between the above-mentioned fixed positions as the gudgeon 37 is provided eccentrically on an arm 39 which can turn half a turn around an axis 40 and which can be fixed in one or other position, for example by means of a non-represented screw. It is clear that the gudgeon 37 can also be adjusted in other ways.

The working of the device 1 is very simple and as follows.

In order to realize a turn tilt metalwork, the U-shaped element 14 and the coupling element 37 are put in a position as shown in FIGS. 9A and 9B representing the situation in which the window 1 is closed and the leaf 3 is locked in relation to the frame 2, whereby the locking pins 26 mesh in the frame 2 whose inner edge 41 is represented by means of a dashed line.

This situation corresponds for example to a downward directed closing position of the control crank 15.

When the crank 15 is turned for example a quarter of a turn as of this position to a first opening position, the slide laths 18 will be pushed down and the slide lath 28 is moved to the left, as a result of which the locking pins 26 are withdrawn from the recesses 27 in the frame 2.

Figure 10A:
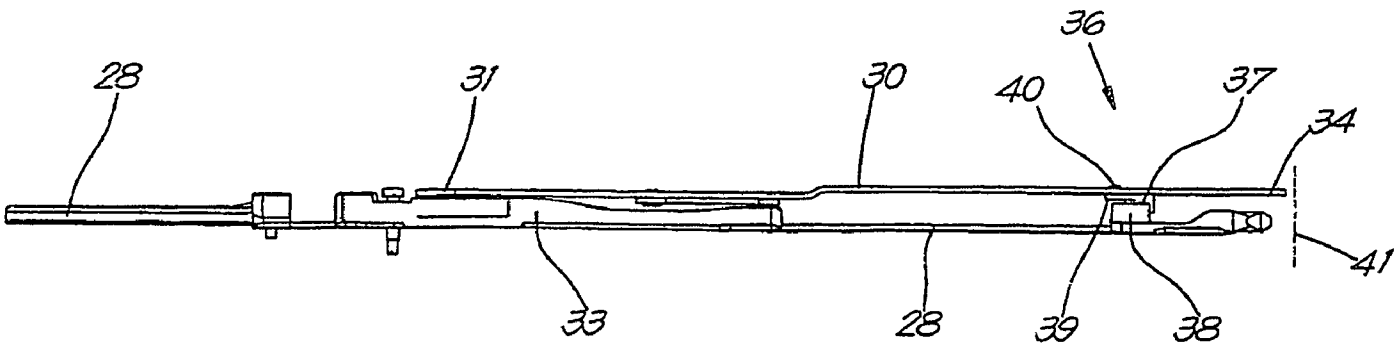
Figure 10B:
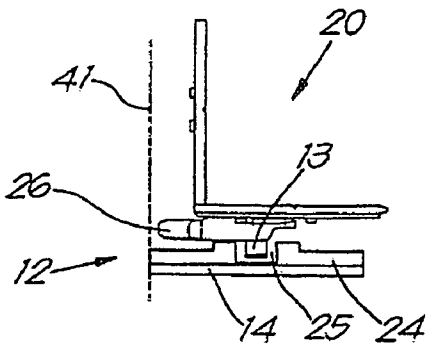

The shear mechanism 29 is simultaneously locked, as shown in FIG. 10A, while the hinge pin 13 is withdrawn from the hinge part 14 up to opposite the recesses 25 in the U-shaped hinge part, as shown in FIG. 10B, as a result of which the window can be turned open around the vertical axis X-X' while the window is prevented from tilting round the axis Y-Y'.

Figure 11A:
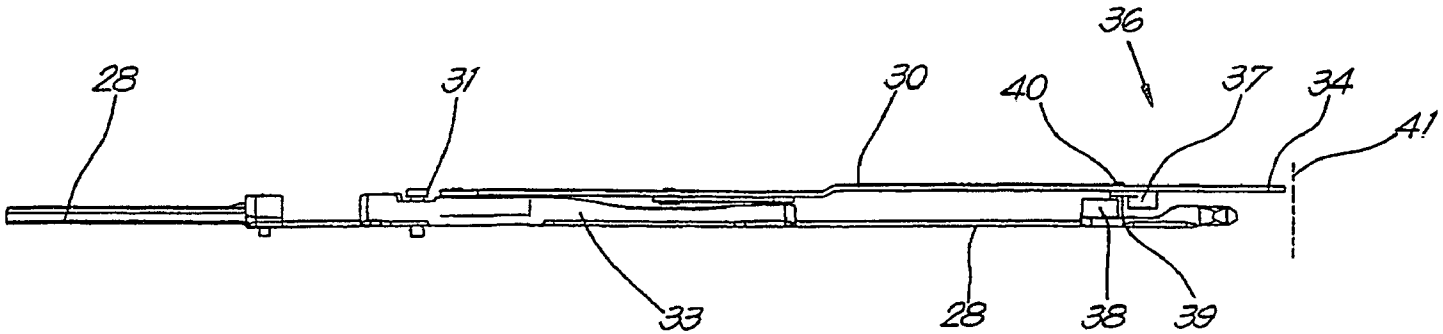
Figure 11B:
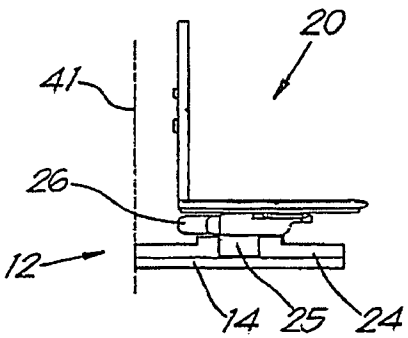

When the crank 15 is turned a quarter of a turn further into a second opening position, the shear mechanism 29 will be unlocked, as shown in FIG. 11A, and the hinge pin 13 will be simultaneously pushed in the hinge part 14 so as to co-operate in a hinged manner.

It is clear that, in this way, the leaf 3 can be tilted open as of the closed position of the window 1 round the horizontal axis Y-Y', while the window 1 is prevented from turning round the axis X-X'.

In order to make a tilt before turn window out of the turn tilt window, one only has to rotate the coupling element 37 into a position whereby the gudgeon 37 is moved to the left, as shown in FIG. 12A, and to move the hinge part 14 to the right into a position as shown in FIG. 12B.

These FIGS. 12A and 12B correspond to a position of the crank 15 corresponding to the above-mentioned closing position of the crank 15.

Figure 13A:
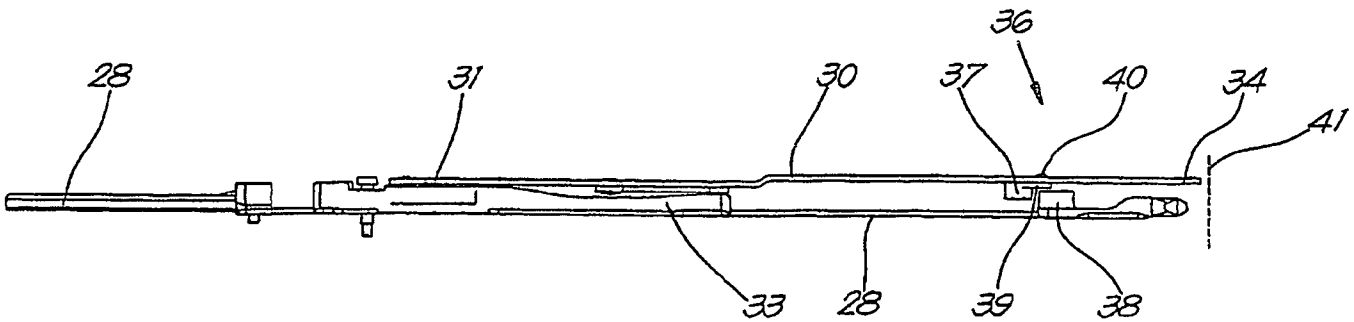
Figure 13B:
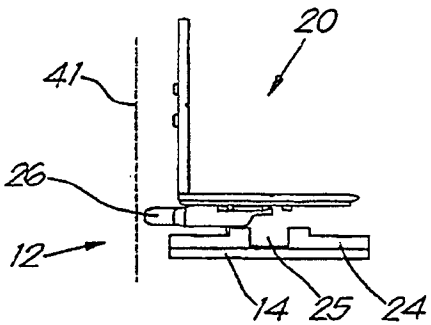
Figure 14A:
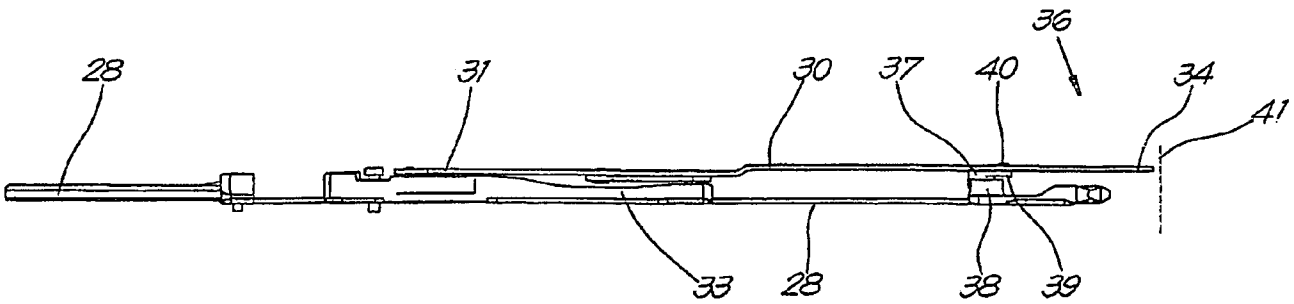
Figure 14B:
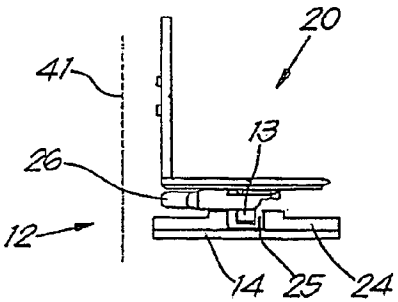

When the crank 15 is turned into the first opening position as of this position, the shear mechanism will be unlocked, as shown in FIGS. 13A and 13B, and the hinge parts 13 and 14 will be hinged, such that the window can tilt.

If the crank is turned even further then up to the second opening position, the shear mechanism 28 will be locked and the hinge 12 will be disconnected, such that the window can be turned open.

It is clear that is very simple to switch from a turn tilt to a tilt before turn type of metalwork by simply moving or adjusting the elements 14 and 37.

It is also clear that the same result could be obtained by moving the elements 13 and 38 co-operating with the latter or by mutually moving the co-operating elements.

According to a special aspect of the invention, an angle drive 20 is applied as represented in detail in FIG. 3 which is formed of a hooked guide 42 with a guide chute 42A in which an elastic flexible lath 43 can shift, which lath 43 is provided with a coupling piece 44 in the shape of a springy snap-in system at its far ends to connect the other above-mentioned slide laths 18,21,28 or other elements of the metalwork 6 to.

The coupling piece 44 of FIG. 3 is formed of a holder 45 which is fixed at a far end concerned of the flexible lath 43 under said lath 43, in this case by means of hooks 46 that spring back.

The holder 45 is provided with a space 47 that is confined by a bottom 48 in which has been provided a body 49 which is pushed between the body 49 and the bottom 48 in the direction of the lath 44 by means of a spring 50 and on which ale provided two buttons or protrusions 51 in this case, extending through passages in the flexible lath 43 and protruding over a certain length from the top of the latter when in rest.

These protrusions 51 are designed to work in conjunction with complementary passages or recesses 52 of a part of the metalwork 6 to be coupled, as shown in FIG. 15.

The two protrusions 51 are situated at a distance from one another, which makes it possible to simultaneously connect two elements to one and the same end of the flexible lath 43 of the angle drive 20 if necessary, as shown for example in FIG. 15, where a slide lath 18 and a locking pin 26 are connected to one single coupling piece 44.

Naturally, the coupling piece 44 may be provided with only one protrusion 51 or the coupling piece 44 can be designed with two protrusions which are each independently spring-mounted.

Thanks to this system of coupling pieces 44, the metalwork can be very easily mounted. To this end, an angle drive 20 is mounted first for example, after which the lath 28 is pushed in the groove in the metalwork 7 of the upper post 4, for example up to the corner piece 20 and over a protrusion 51 which is simultaneously being pushed in against the force of the spring 50.

When the recess 52 at the far end of the slide lath 28 comes over the protrusion 51, said protrusion 51 will snap in the recess 52, thus guaranteeing a connection between the slide lath 28 and the flexible lath 43 of the corner piece 20.

According to yet another aspect of the invention, the control 15 may be provided with a locking mechanism which has been integrated for example in the base 16 and which prevents the control crank 15 from being turned further into the second opening position.

Thus, a window which can only turn open is obtained for a turn tilt type of metalwork, and a window which can only tilt is obtained for a tilt before turn type of metalwork.

The present invention is by no means restricted to the embodiment described by way of example and represented in the accompanying drawings; on the contrary, such a metalwork according to the invention and the accompanying elements can be made in all sorts of shapes and dimensions while still remaining within the scope of the invention.

The invention claimed is:

1. An operational mechanism for a window comprising a fixed frame (2) and a leaf (3), and a control (15) of the operational mechanism, which, when operational is arranged to open and close the leaf (3) to turn around a vertical axis (X-X') by use of hinges (11) or which can tilt around a horizontal axis (Y-Y') depending on the position of the control (15) arranged to move from a closing position in which the window (1) is closed, to a first opening position for one of either of the turning or tilling movements of the leaf (3) depending on the window, in particular turning for a turn tilt window (1) or tilting for a tilt turn window (1), and further to a second opening position for another movement of either one of said turning or tilting movements of the leaf depending on the window, in particular tilting for a turn tilt window (1) or turning for a tilt turn window (1), the operational mechanism comprising:

a scissor mechanism (29) comprising a guide to be mounted on the leaf and a main arm (30) which is hinge-mounted to a carriage (32) which can shift on the guide and which is connected to a hinge of the vertical axis (X-X') when operational;

a slide latch (28) shiftable by the control (15) over an outer perimeter (8) of the leaf;

a locking device for locking and unlocking the main arm in relation to the leaf (3), the locking device having two coupling elements, a first coupling element (37) located on the main arm (30) and a second coupling element (38) located on the slide latch (28) respectively, which coupling elements can mesh to lock the main arm (30) by controlling the operational mechanism (6) for allowing turning of the leaf or be moved apart in view of the free movement of the main arm (30) for allowing tilting of the leaf, wherein the first coupling element (37) is formed as a gudgeon fixed on a rotating arm (39) which is rotatable around an axis (40) with respect to the main arm, the gudgeon being positioned eccentrically on the rotating arm (39) at a distance from the axis (40) and working in conjunction with the second coupling element (38), the rotating arm (39) arranged to turn in a reversible manner half a turn between two lockable positions:

a first lockable position corresponding to a turn tilt operational mechanism (6) wherein the first and second coupling elements are meshed when the control (15) is in a closing or first opening position and are disengaged when the control (15) is in a second opening position;

a second lockable position corresponding to a tilt turn operational mechanism (6), wherein the first and second coupling elements are disengaged when the control (15) is in the closing or first opening position and are meshed when the control (15) is in the second opening position.

2. The operational mechanism according to claim 1, wherein the transformation from one operational mechanism (6) into another operational mechanism (6) is made possible by adjusting two elements.

3. The operational mechanism according to claim 1 further comprising a detachable hinge (12) for tilling the window (1) with two disconnectable hinge parts including a second hinge part (14) located on the fixed frame (2) and a first hinge part (13) located on the leaf (3) respectively, arranged to be pushed in or out of one another by means of the control (15) of the operational mechanism (6), in order to tilt the window (1) and in order to turn the window (1) respectively, wherein at least one of the first and second hinge parts (13-14) is adjustable to transform the operational mechanism (6) from a turn tilt operational mechanism into a tilt turn operational mechanism by mutual adjustment.

4. The operational mechanism according to claim 3, wherein the first and second hinge parts (13-14) for a turn tilt operational mechanism (6) are placed such in relation to one another that the first and second hinge parts (13-14) are pushed into one another for a first opening position of the control (15), wherein the first and second hinge parts are pushed out of one another for the second opening position, and that for a tilt turn operational mechanism (6), the first and second hinge parts (13-14) are placed such that, for the first opening position of the control (15), the first and second hinge parts (13-14) are pushed out of one another, and for the second opening position, the first and second hinge parts (13-14) are pushed into one another.

5. The operational mechanism according to claim 4, wherein the second hinge part (14) is adjustable between two positions on the fixed frame (2) along an inner edge (41) of the frame (2), corresponding to a position for a turn tilt operational mechanism and a position for a tilt turn operational mechanism respectively, and in that the first hinge part (13) is provided on the leaf (3) on a slide lath (21-43) shiftable over the outer perimeter (8) of the leaf (3) by means of the control (15).

6. The operational mechanism according to claim 5, wherein the first hinge part (13) on the slide lath (21-43) of the leaf (3) is a hinge pin, wherein the second hinge part (14) on the frame (2) is made as a U-shaped element provided on the inner perimeter (41) of the frame (2) with the legs (24) pointing inward and which can be moved over the inner perimeter (41) of the frame (2) between two positions that can be locked, corresponding to a turn tilt or a tilt turn operational mechanism (6), respectively.

7. The operational mechanism according to claim 6, wherein the U-shaped element (14) is a U-shaped post such that the legs (24) are provided with a recess (25) over a certain length in the central part.

8. The operational mechanism according to claim 3, wherein in order to transform a turn tilt operational mechanism (6) into a tilt turn operational mechanism (6), one of both the first and second coupling elements (37-38) of the locking device of the scissor mechanism (29) and one of the first and second hinge parts (13-14) of the detachable hinge (12) are adjusted before tilting.

9. The operational mechanism according to claim 3, further comprising a locking mechanism having at least one locking pin (26) located in a corner of the window (1), the locking pin (26) shiftable over the perimeter (8) of the leaf (3) by the control (15) between a position wherein, in the closing position of the control (15), the locking pin (26) meshes in a recess (27) of the frame (2), wherein in the first and second opening positions of the control (15), the locking pin (26) is withdrawn from said recess (27) in the frame (2).

10. The operational mechanism according to claim 9, wherein at least one of the first and second hinge parts (13-14) is provided on or is part of the locking pin (26).

11. The operational mechanism according to claim 9, wherein the control (15) is composed of at least one slide lath (18-21-28) arranged to shift over the outer perimeter (8) of the leaf (3), in a groove in the operational mechanism (6) in the outer perimeter (8) of the leaf (3), wherein an angle drive (20) is applied in a corner of the leaf (3) and includes a hooked guide (42) in which an elastic flexible lath (43) can shift and is provided with a coupling piece (44) on far ends thereof in the shape of a snap-in system for connecting to other of the slide laths (18-21-28).

12. The operational mechanism according to claim 11, wherein the coupling piece (44) is formed of a holder (45) fixed under the flexible lath (43) at a far end thereof and having a body (49) pushable in a direction of the flexible lath (43) by means of a spring (50) and on which is provided a protrusion (51) extending through a passage in the flexible lath (43) and protruding over a certain length from the top of the latter when in rest, wherein the protrusion (51) is arranged to co-operate with a recess (52) of a part of the operational mechanism (6) to be coupled.

13. The operational mechanism according to claim 12, wherein the body (49) is provided with two protrusions (51) located at a distance from one another such that two elements of the operational mechanism (6) are arranged to be simultaneously connected to far end of the flexible lath (43) of the angle drive (20).

14. The operational mechanism according to claim 13, wherein a slide lath (18-21-28) and the locking pin (26) or the first hinge part (13) can be simultaneously connected to the far end of the flexible lath (43) of the angle drive (20).

15. The operational mechanism according to claim 1, wherein the control (15) is provided with a locking mechanism preventing the control (15) from being moved to the second opening position.

* * * * *